US006393750B1

(12) United States Patent
Rossini et al.

(10) Patent No.: US 6,393,750 B1
(45) Date of Patent: May 28, 2002

(54) DEVICE FOR INHIBITING THE LOADING AND USE OF PORTABLE GUNS

(75) Inventors: Luigi Rossini; Pierino Rossini, both of Pavone Mella; Massimo Bresciani, Leno, all of (IT)

(73) Assignee: Stil Crin di Rossini P. & C. S.n.c. (IT)

( * ) Notice: Subject to any disclaimer, the term of this patent is extended or adjusted under 35 U.S.C. 154(b) by 0 days.

(21) Appl. No.: 09/614,743

(22) Filed: Jul. 12, 2000

(30) Foreign Application Priority Data

Nov. 16, 1999 (IT) ..... BS99A00106

(51) Int. Cl.[7] ..... F41A 17/00
(52) U.S. Cl. ..... 42/70.11
(58) Field of Search ..... 42/70.01, 70.08, 42/70.11

(56) References Cited

U.S. PATENT DOCUMENTS 2,405,308 A * 8/1946 Jack ..... 434/19
3,137,957 A * 6/1964 Ingalls ..... 42/70.11
3,378,943 A * 4/1968 Valburg ..... 42/70.11
3,710,490 A * 1/1973 Cornett et al. ..... 42/70.11
3,720,014 A * 3/1973 Goodrich ..... 42/70.11
4,224,753 A * 9/1980 Bielman ..... 42/70.11
4,969,284 A * 11/1990 Healey et al. ..... 42/70.11
4,999,940 A * 3/1991 Maden ..... 42/70.11
5,860,241 A * 1/1999 Waters ..... 42/70.11
6,131,326 A * 10/2000 Case ..... 42/96

* cited by examiner

*Primary Examiner*—Charles T. Jordan
*Assistant Examiner*—Jordan Lofdahl
(74) *Attorney, Agent, or Firm*—McGlew and Tuttle, P.C.

(57) ABSTRACT

A device for inhibiting the loading and use of portable guns such as rifles, pistols and the like for purposes of safety when a gun is transported or put away. The device comprises a dummy cartridge (11) to be inserted into the cartridge chamber of the barrel of a gun, a cable (12) which starts from the dummy cartridge, extends into the barrel for the entire length of same and ends with a final spacer (13) protruding from the muzzle end of the barrel, and a lock (14) applied to said spacer and resting directly or indirectly against the muzzle of the barrel.

7 Claims, 2 Drawing Sheets

DEVICE FOR INHIBITING THE LOADING AND USE OF PORTABLE GUNS

FIELD OF THE INVENTION

The present invention pertains to the sector of portable guns such as rifles and pistols, and it pertains specifically to a safety device for such guns.

BACKGROUND OF THE INVENTION

So-called blank firing pins, consisting of a dummy cartridge that is inserted in the cartridge chamber of the gun, are currently available in the field of portable guns. Instead of the trigger unit, this dummy cartridge has a spring-loaded piston, which draws back elastically if struck by a firing pin, in such a manner that this is not needlessly subjected to wear and tear during the maintenance and/or blank tests of the gun. However, the blank filing pin may be removed from the cartridge chamber; therefore, the gun may be loaded and remain loaded inadvertently with the risk of an uncontrolled or accidental firing, e.g., due to the falling of the gun, of the shot in the barrel.

In other words a blank firing pin in itself is not able to absolutely inhibit an uncontrolled use of the gun and to avert the danger of accidental firings of shots when the gun is transported and/or is put away.

SUMMARY AND OBJECTS OF THE INVENTION

The object of the present invention is to propose and provide a safety device that is able to effectively inhibit both the loading and the use of a gun, such as a rifle or pistol, to prevent the risks and dangers mentioned above of an involuntary operation of the gun proper.

Another object of the present invention is to propose and provide a device that, in addition to preventing the use of the gun, is able to protect the integrity of the firing pin and to allow freedom to open and close the gun, by unlocking and rotating the barrels in the case of rifles and by moving the carriage lock in the case of pistols.

These objects, and the advantages that derive from them in terms of the safety of a gun, are accomplished with a device essentially comprising a dummy cartridge to be inserted in the cartridge chamber of the barrel of a gun, a cable which starts from dummy cartridge, extends into the barrel for the entire length of same and ends with a spacer protruding from the muzzle end of the barrel, and a lock applied to said spacer and resting against the muzzle of the barrel to prevent the removal, if not voluntary, of the dummy cartridge so as to inhibit the loading and the use of the gun.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS In the drawings.

DESCRIPTION OF THE PREFERRED EMBODIMENTS

Figure 1:
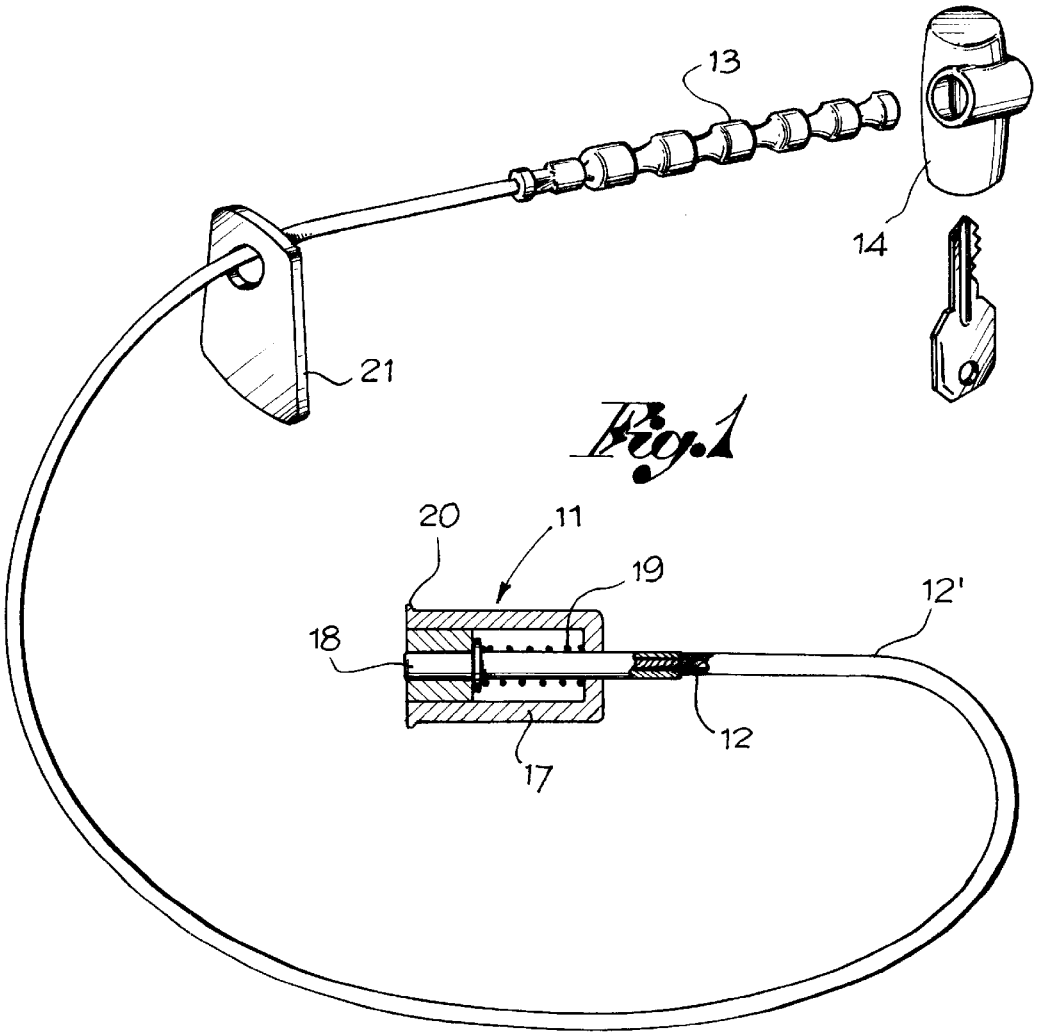
FIG. 1 is a partial sectional perspective view of a safety device for rifles.

Referring to the drawings in particular, the device of the invention comprises a dummy cartridge 11, a cable 12, a spacer 13 and a lock 14.

The dummy cartridge 11 is shaped to be able to be inserted into the cartridge chamber 15 of the barrel 16 of a gun which may be a rifle (FIG. 2) or pistol. The dummy cartridge 11 comprises a body 17 in which may be housed, and longitudinally guided, a piston 18 loaded by a spring 19 and acting as the blank firing pin.

In the dummy cartridge for rifles (FIG. 1) the body 17 has a bottom edge 20 intended to be usually engaged with the extractor of the gun, and the piston 18 can be moved towards the interior of the body when struck by the firing pin, while the body 17 can be moved in a limited manner backwards with respect to the piston when, following the opening of the gun, the extractor engages the bottom edge 20 of the dummy cartridge.

Thus, it is possible to open the gun without difficulty, allowing the dummy cartridge into the cartridge chamber.

Figure 3:
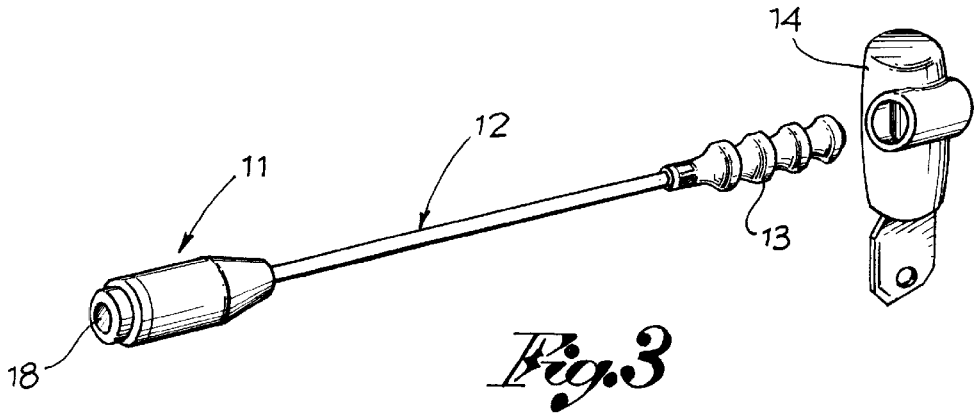
FIG. 3 is a perspective view showing a safety device for pistols.

In the dummy cartridge for pistols (FIG. 3) the body 17 does not have an edge to make it possible to move the carriage lock, with the dummy cartridge remaining fixed in the barrel, and this body cannot be moved backwards with respect to the blank firing pin piston.

The cable 12 is preferably made of steel, and it passes in a sheath 12'. It has a proximal end fixed to the body 17 or preferably to the piston 18 of the dummy cartridge 11 and a length which is compatible with the length of the barrel of the gun, to which the device is applied.

The spacer 13 is fixed at the distal end of the cable 12, and when the device is applied to a respective barrel, this spacer 13 must protrude at least partially from the muzzle end of the barrel proper.

The lock 14 can be applied to the spacer by making it rest against the muzzle of the barrel, possibly with the placement of a protective element 21 therebetween.

Figure 2:
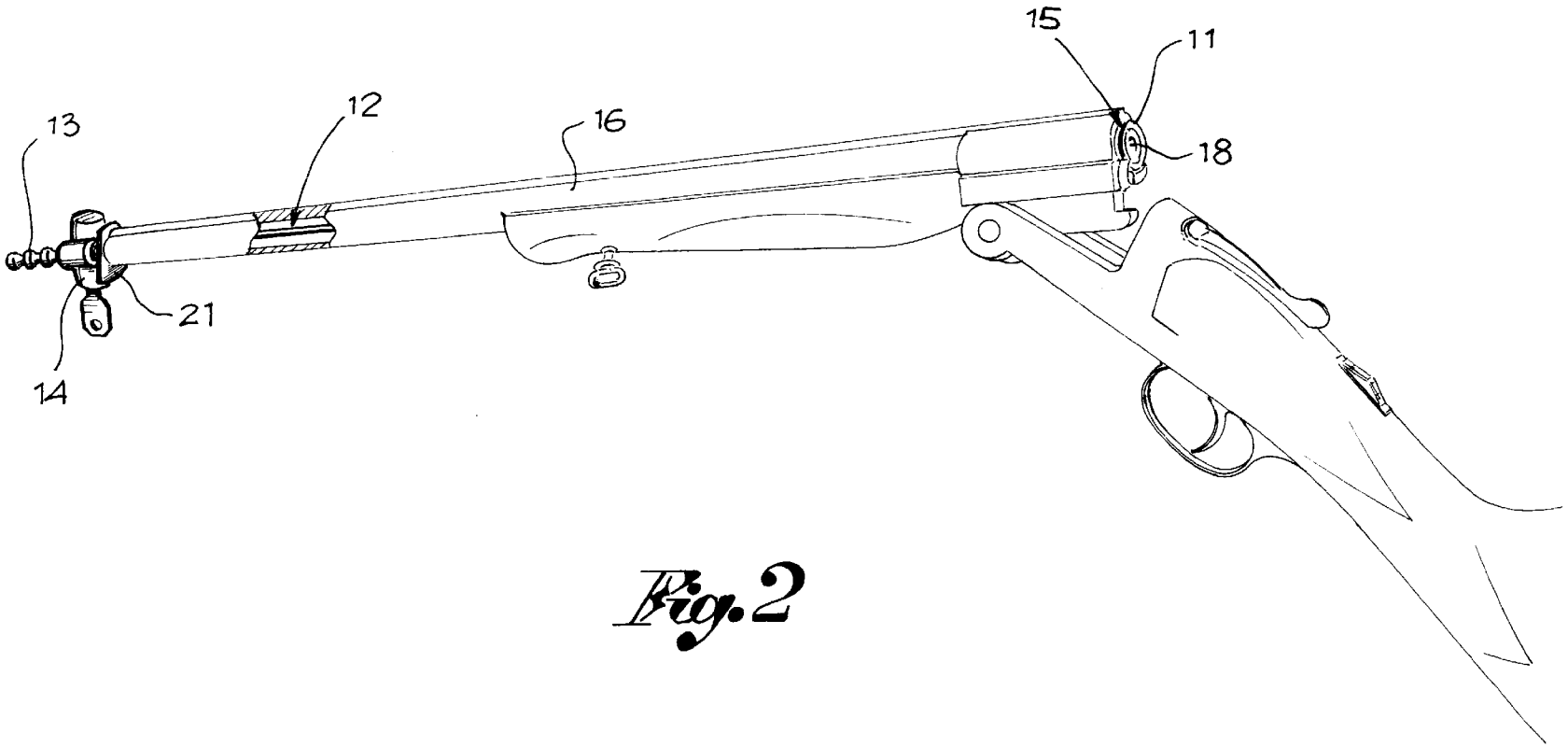
FIG. 2 is a perspective view of a device of FIG. 1 applied to the barrel of a rifle.

The device described above is used by threading in the barrel, from the breech, the cable 12 complete with spacer 13 until the dummy cartridge blank firing pin 11 is arranged in the cartridge chamber. The possible protective element 21 and the lock 14 are then applied to the spacer 13, which protrudes from the muzzle of the barrel (FIG. 2). In this way, even if it can be opened and closed, the gun cannot be loaded and at least cannot be used, thus guaranteeing the safety, as long as no action is taken to voluntarily remove the device.

While specific embodiments of the invention have been shown and described in detail to illustrate the application of the principles of the invention, it will be understood that the invention may be embodied otherwise without departing from such principles.

What is claimed is:

1. A device for inhibiting the loading and use of portable guns such as rifles and pistols and the like, for purposes of safety when a gun is transported or put away, the device comprising:

a dummy cartridge insertable into a cartridge chamber of the barrel of a gun, said dummy cartridge comprising a body and a spring-loaded piston guided in said body and movable a predefined distance with respect to said body between two stop positions, said spring-loaded piston of said dummy cartridge being longitudinally movable in and with respect to said body and said body being movable with respect to said piston said spring-loaded piston being disposed to act as a blank firing pin and said body having side walls positionable in the cartridge chamber and a bottom edge extending outwardly of the cartridge chamber for interacting with an extractor;

a cable which extends from said spring-loaded piston of said dummy cartridge into the barrel for the entire length of the barrel and ends with a final spacer protruding from the muzzle end of the barrel; and a lock connectable to said spacer and resting directly or indirectly against the muzzle of the barrel in a connected position to hold said dummy cartridge and to prevent outward movement of said piston relative to cartridge chamber and to prevent the removal of said body from said cartridge chamber beyond said predefined distance.

2. A device in accordance with claim 1, further comprising a sheath and a protective element, wherein said cable is inserted into said sheath and said protective element is placed between said lock and the muzzle of the barrel.

3. A device for inhibiting the loading and use of a gun, the device comprising:

a cartridge shaped element insertable into a cartridge chamber of the barrel of the gun the cartridge shaped element including a body and a spring-loaded piston guided in the body and movable with respect to the body between two stop positions, the spring-loaded piston acting as a blank firing pin, the spring loaded piston having a cable connection;

a spacer element;

a cable element with an end fixed to said spring loaded piston cable connection to prevent relative movement between the cable element end and the cable connection, the cable being of a length to extend from the cartridge shaped element for the entire length of the barrel, the cable being connected to the spacer element, whereby in use, the spacer element protrudes from the muzzle end of the barrel with the cable extending the entire length of the barrel from the spacer to the cartridge shaped element inserted into the cartridge chamber; and a lock connectable to the spacer and resting directly or indirectly against the muzzle of the barrel in a connected position to prevent the cartridge shaped element from coming out of the cartridge chamber.

4. A device in accordance with claim 3, wherein the spring-loaded piston of the cartridge shaped element is longitudinally movable in and with respect to the body and the body is movable on and with respect to the piston, and the body has a bottom edge for interacting with an extractor if the device is designed for the application to rifles.

5. A device in accordance with claim 3, further comprising a sheath and a protective element, wherein the cable is inserted into the sheath and the protective element is placed between the lock and the muzzle of the barrel.

6. A device for inhibiting the loading and use of a gun, the device comprising:

a cartridge shaped element insertable into a cartridge chamber of the barrel of the gun the cartridge shaped element including a body with a cylindrical wall providing walls of a cartridge shape and a bottom edge extending outwardly of the cartridge chamber for interacting with an extractor and a piston guided in said body and movable a predefined distance with respect to said body between two stop positions, said piston being spring loaded to be biased toward one of said two stop positions, said piston being longitudinally movable in and with respect to said body and said body being movable with respect to said piston said spring-loaded piston being disposed to act as a blank firing pin;

a cable element with a piston connecting end and an opposite end, said piston connecting end being connected to said piston and said cable element being of a length to extend the length of the barrel from the cartridge shaped element, disposed in the cartridge chamber, to an opposite end;

a spacer piece connected to said opposite end; and a lock connectable to said spacer piece and resting directly or indirectly against the muzzle of the barrel in a connected position to prevent the piston element from coming out of the cartridge chamber and limiting the extent the body comes out of the cartridge chamber to said predefined distance.

7. A device in accordance with claim 6, further comprising a sheath and a protective element, wherein the cable is inserted into the sheath and the protective element is placed between the lock and the muzzle of the barrel.

* * * * *